US008297735B2

(12) United States Patent
Garcia et al.

(10) Patent No.: US 8,297,735 B2
(45) Date of Patent: Oct. 30, 2012

(54) PRINTHEAD AND METHOD OF PRINTING

(75) Inventors: Enric Odena Garcia, Barcelona (ES); Utpal Sarkar, Barcelona (ES); Jaime Fernandez, Barcelona (ES); Nuria Jomet, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 500 days.

(21) Appl. No.: 12/248,913

(22) Filed: Oct. 10, 2008

(65) Prior Publication Data

US 2010/0026748 A1 Feb. 4, 2010

Related U.S. Application Data

(60) Provisional application No. 61/085,595, filed on Aug. 1, 2008.

(51) Int. Cl.
*B41J 23/00* (2006.01)

(52) U.S. Cl. ..... 347/37

(58) Field of Classification Search ..... 347/37, 347/42

See application file for complete search history.

(56) References Cited

U.S. PATENT DOCUMENTS

| | | | | |
|---|---|---|---|---|
| 5,587,730 | A | 12/1996 | Karz | |
| 5,984,470 | A * | 11/1999 | Sakino et al. | 347/106 |
| 6,293,650 | B1 * | 9/2001 | Sette et al. | 347/37 |
| 2002/0080210 | A1 | 6/2002 | Verhoest et al. | |
| 2005/0063666 | A1 | 3/2005 | Takatsuka | |
| 2005/0140722 | A1 | 6/2005 | Shibata et al. | |
| 2006/0103707 | A1 * | 5/2006 | Askeland et al. | 347/101 |
| 2006/0227157 | A1 | 10/2006 | Drake et al. | |

FOREIGN PATENT DOCUMENTS

| | | |
|---|---|---|
| EP | 1870239 | 12/2007 |

* cited by examiner

*Primary Examiner* — Geoffrey Mruk

(57) ABSTRACT

A printhead for a printer in which a print medium advances in a media advance direction, said printhead being static when printing and having an adjustable length in a width direction that is perpendicular to said media advance direction, such that the length of the printhead in said width direction can be adjusted to the width of the image to be printed.

17 Claims, 7 Drawing Sheets

PRINTHEAD AND METHOD OF PRINTING

CROSS-REFERENCE TO RELATED APPLICATION

This Utility Patent Application is based on and claims the benefit of U.S. Provisional Application No. 61/085,595, filed on Aug. 1, 2008 the contents of which are hereby incorporated by reference in their entirety.

The present invention relates to a printhead and a method of printing.

A printer is generally used for (re)producing text and images. Throughout this application, when reference is made to an image or images, this is to be interpreted as also explicitly referring to text (not only figures).

Different types of printers are known, amongst which laser printers, thermal printers, dot matrix printers and inkjet printers.

Inkjet printers use at least one printhead provided with a plurality of nozzles, from which ink droplets are fired or ejected onto the media; the printer controls the firing of ink from the nozzles such as to create on the media a pattern of dots corresponding to the desired image.

In one type of inkjet printers, the printheads may be mounted on a carriage that reciprocates in successive passes above the media along a scan direction, with the nozzles firing droplets of ink as the printhead moves across the media; after each printing pass of the printheads, the media is advanced in a media advance direction, at right angles to the scan direction, such that a plot is formed on the media in successive passes of the printheads. These printheads are sometimes referred to as scanning printheads or shuttle printheads. These printers are sometimes referred to as shuttle printers.

In another type of inkjet printers, the printhead extends over the width of the printer and is static when printing. The nozzles of the printhead fire droplets of ink while the media advances in a media advance direction. The printheads are sometimes referred to as page wide printheads or full width printheads. These printers are sometimes referred to as full width printers.

Full width printers have advantages compared to shuttle printers, such as high throughput and improved reliability, e.g. due to the fact that they have less moving parts. However, these printers generally operate at a relatively low efficiency when the printer is used to print on media that is narrow compared with the maximum media width accepted by the printer, because in this case a significant proportion of the printhead remains idle during the printing operation. Another disadvantage is a lack of redundancy: if a nozzle does not function properly, this fault can hardly be compensated by other nozzles, whereas this is possible using a shuttle printhead. Another known disadvantage is the high cost of manufacturing a full width printhead (especially for large size printers).

The present invention aims at providing a printhead and a method of printing for printers with a printhead that is static when printing in which at least part of the above disadvantages are alleviated.

According to a first aspect, the present invention relates to a printhead for a printer in which a print medium advances in a media advance direction, said printhead being static when printing and having an adjustable length in a width direction that is perpendicular to said media advance direction, such that the length of the printhead in said width direction can be adjusted to the width of the image to be printed.

A higher efficiency in printing can be achieved because the length of the printhead can be adapted to the width of the image. The length of the printhead will namely be chosen such that the part of the printhead that remains idle during printing is reduced. It will be appreciated that the orientation of the printhead is not necessarily exactly in the width direction. The printhead may e.g. form an angle of 30° (or any other angle) with the width direction as long as the printhead has an adjustable length in the width direction.

According to another aspect, the present invention relates to a printhead assembly for printing on a medium which advances in a media advance direction, said printhead assembly being static when printing and comprising at least two printhead modules, said printhead modules being offset in said media advance direction, at least one of said printhead modules being adapted to be moved along a width direction, which is perpendicular to said media advance direction, whereby the printhead modules can be positioned appropriately to adjust the printhead assembly to the width of the image to be printed.

According to yet another aspect, the present invention relates to a method of printing using a printhead which is static when printing and comprises at least two printhead modules of which at least one printhead module is movable comprising the steps of determining the width of the image to be printed, and positioning the printhead modules in such a way that the image can be printed.

Determining the width of the image to be printed in this sense does not necessarily mean that the exact width of the image is determined. It may also mean determining the width of the medium that the image is to be printed on. Throughout the application, when reference is made to the determination of the image width, this is to be interpreted as encompassing both these options.

Particular embodiments of the present invention will be described in the following, only by way of non-limiting example, with reference to the appended drawings, in which.

Figure 1:
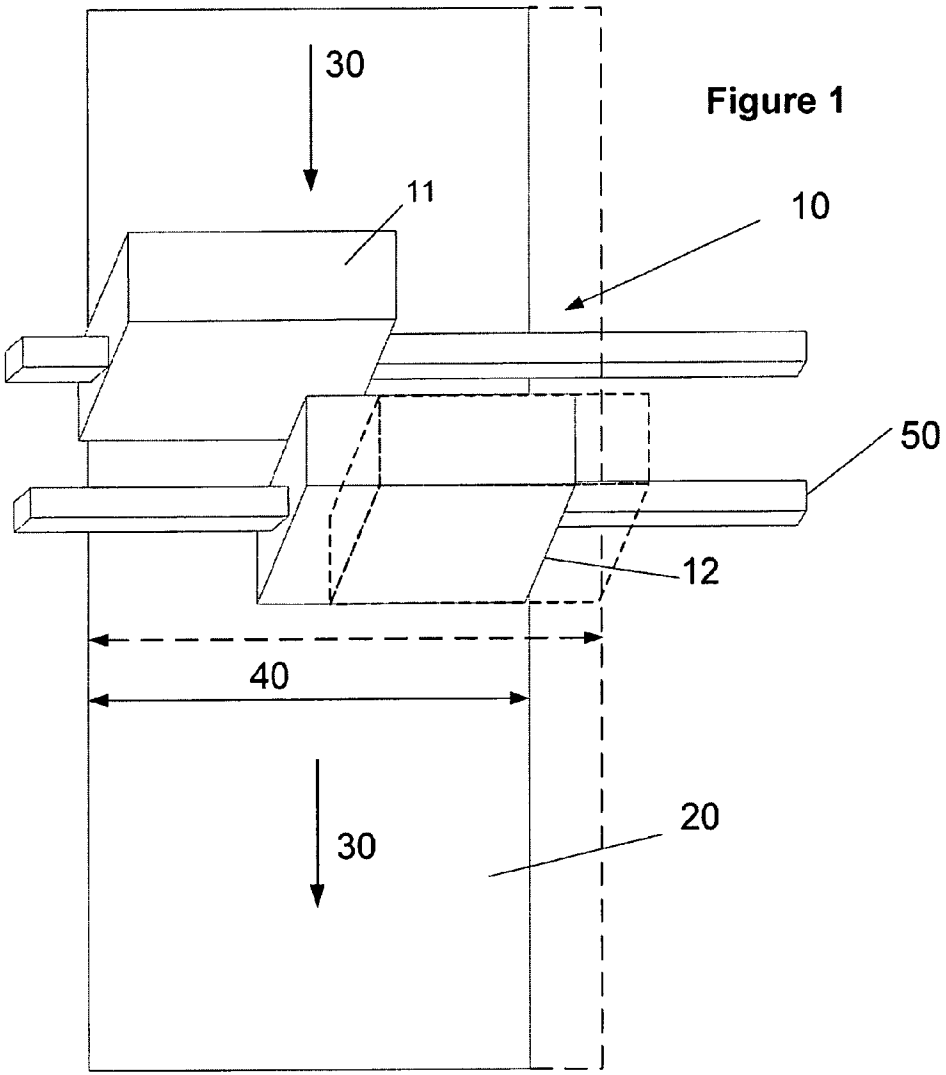
FIG. 1 is a perspective view showing a printhead assembly according to an embodiment of the present invention.

An embodiment of a printhead assembly 10 according to the invention is shown in perspective in FIG. 1. The print medium is indicated with reference sign 20. The medium advances in the media advance direction indicated by two arrows 30, i.e. in the figure, vertically. The printhead assembly 10 extends in a width direction 40, which is perpendicular to the media advance direction (i.e. in this example, the width direction is horizontal). The printhead assembly of this example comprises a first printhead module 11 and a second printhead module 12. The printhead modules 11 and 12 are static when printing, i.e. the medium moves when printing.

At least second printhead module 12 is adapted to be moved along a width direction 40. Printhead module 12 is mounted on an appropriate guide bar 50 to be able to slide and be positioned along the width of the printer. Printhead module 12 can be moved to such an extent that images that are larger than printhead module 11 can also be printed by the printhead assembly, by appropriately positioning the modules, as is indicated in FIG. 1.

Printhead module 12 is shown in continuous line in a first position, in which images corresponding to a first paper size (shown in continuous line) can be printed. Printhead module 12 is also shown in a dotted line in a second position in which images corresponding to this second paper size (shown partially in dotted line) can be printed.

With media or images of the first size, the full width of two printhead modules is not needed for printing. The printheads are partially overlapping in the media advance direction. So, with images of this first size, the second printhead module 12 provides some redundancy over a certain length of printhead module 11, and thus also over a width of the image or print medium. With images of the second size, printhead module 12 may be placed in a substantially non overlapping way. By positioning the printhead modules, the length of the printhead in the width direction is effectively changed and adapted to the width of the image.

Even though in this example only printhead module 11 is arranged to be movable in said width direction, in other embodiments falling within the scope of the invention, both printhead modules 11 and 12 may be arranged to be movable. And even though in this example, printhead modules 11 and 12 are orientated in the width direction, in other embodiments falling within the scope of the invention, the printhead modules may be orientated in a different direction, forming an angle with the width direction.

Figure 2:
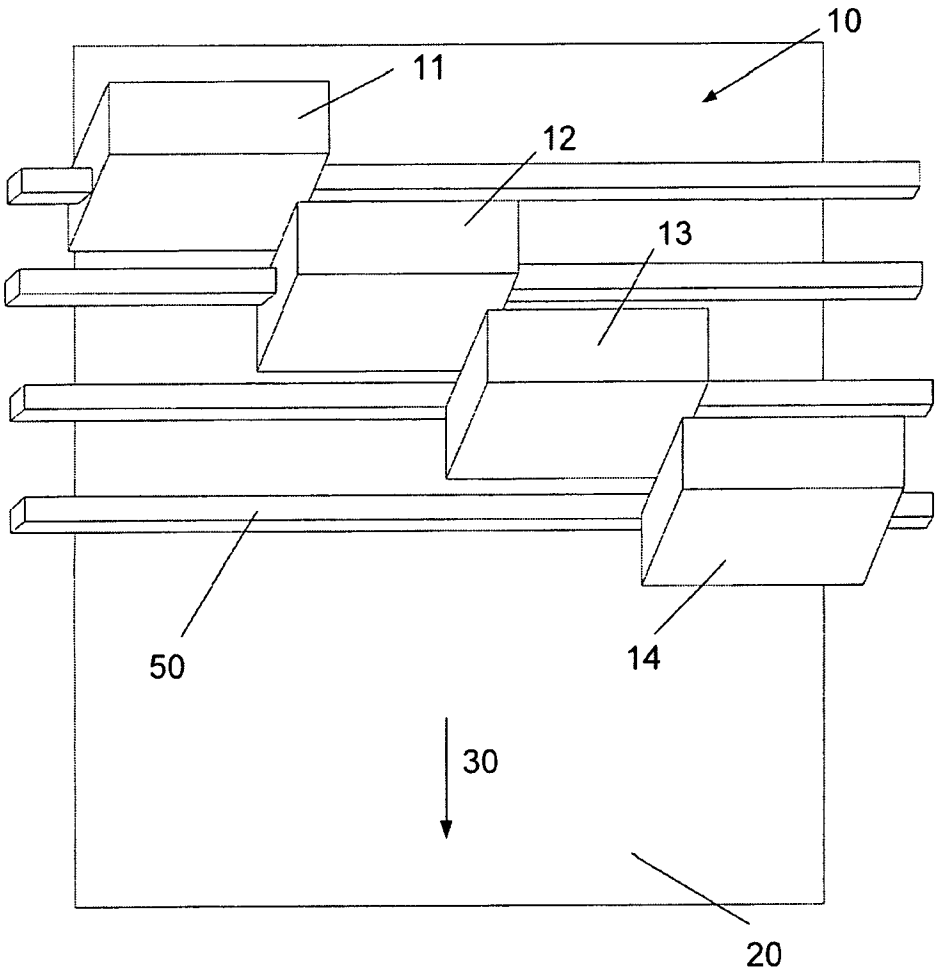
FIG. 2 is a perspective view showing a printhead assembly according to another embodiment of the present invention.

FIG. 2 is a perspective view of another embodiment of the present invention. The printhead assembly is indicated by reference sign 10 and the print medium is indicated by reference sign 20. Printhead assembly 10, according to this embodiment, comprises four printhead modules 11, 12, 13 and 14. In this embodiment, at least printhead modules 12, 13 and 14 are arranged to be movable in a width direction, perpendicular to the media advance direction 30.

In FIG. 2, the four printhead modules are arranged in a substantially non-overlapping way in the media advance direction. Substantially non-overlapping in this sense does not necessarily mean that there is no overlap at all of one module with another module in the media advance direction. For example in an inkjet printer, with reference to FIG. 2, the nozzles at the right end of modules 11, 12 and 13 are in a position in the media advance direction adjacent respectively the nozzles at the left end of each of modules 12, 13 and 14; in this case there is no redundancy and the four modules print much like a single full-width printhead. However, it may be suitable to foresee a slight overlap of the nozzles at the right end of modules 11, 12 and 13 and the nozzles at the left end of modules 12, 13 and 14 respectively to avoid a space between the nozzles of different modules that results in reduced quality at the edges of the modules. It may therefore be necessary to arrange the modules such that the ends of the modules have a slight overlap. Throughout the application, whenever reference is made to printhead modules being arranged in a substantially non-overlapping way in the media advance direction, this is to be interpreted as hereinbefore explained.

Figure 3:
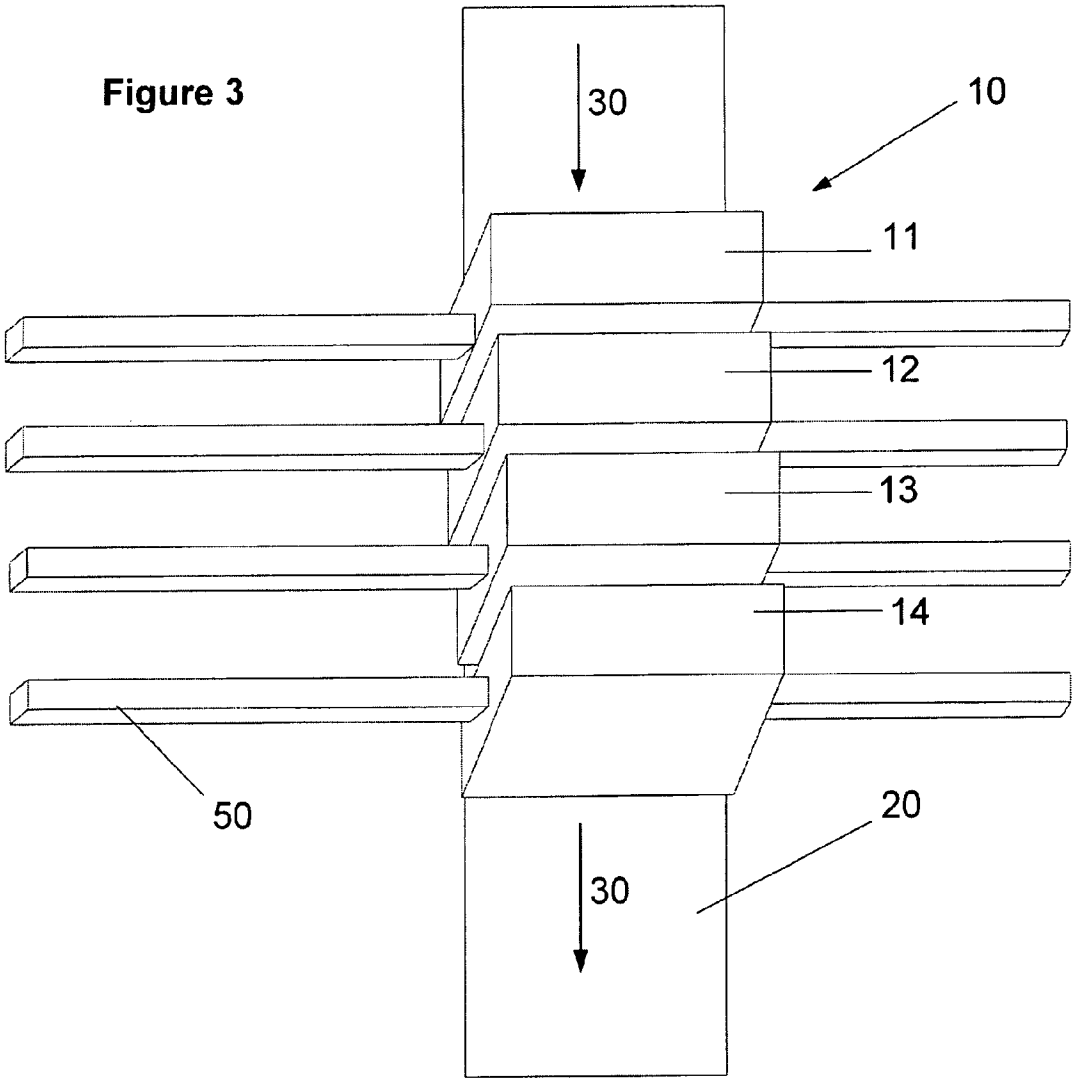
FIGS. 3 and 4 are perspective views of the printhead assembly of FIG. 2, with the printhead modules in a different position.
Figure 4:
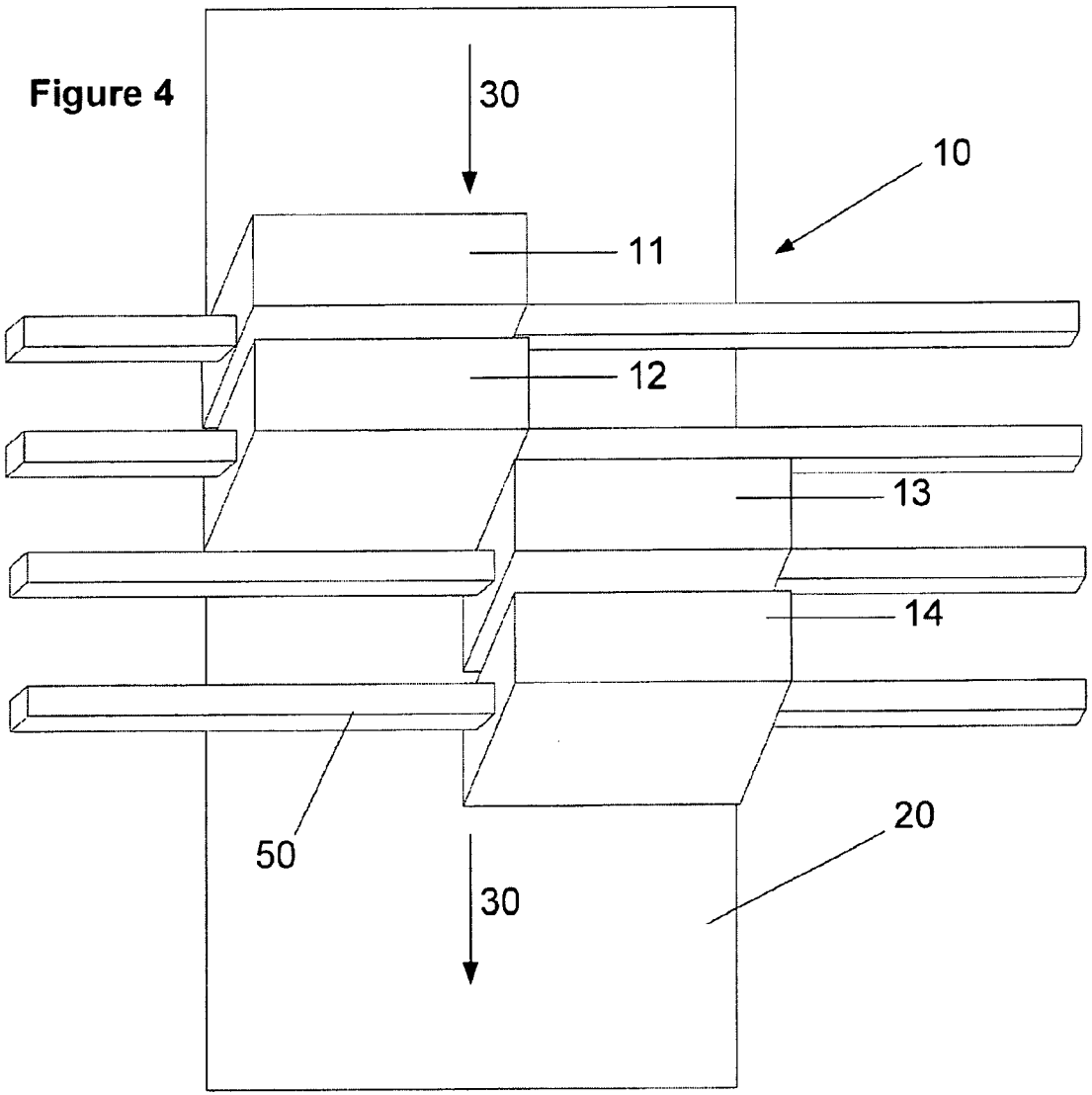

The position shown in FIG. 2 allows printing of large width images. FIGS. 3 and 4 show the printhead assembly according to the same embodiment, but with the printhead modules in a different arrangement.

The positions of printhead modules 11, 12, 13 and 14 shown in FIG. 3 is substantially completely overlapping. Compared to the arrangement of the modules in FIG. 2, with this arrangement the width of the printable images is reduced, but the speed and/or quality at which can be printed can be improved. Additionally, improved error hiding can be incorporated (a failure of a nozzle in one module may be corrected by other modules). Also, the firing frequency of inkjet nozzles may be reduced.

In FIG. 4, a third possible arrangement of the modules according to the same embodiment is shown. Two sets of printhead modules are arranged with their modules substantially completely overlapping (viewed in the media advance direction), but the two sets themselves are arranged to be substantially non-overlapping (viewed in the media advance direction). This position is especially suitable when the image to be printed has the width of two printhead modules. The positioning allows redundancy and high throughput.

To the skilled person it will be clear that in the aforementioned examples illustrated in FIGS. 2, 3 and 4, substantially no part of the printhead goes unused and nozzle redundancy is achieved for most image widths and/or medium widths.

Figure 5:
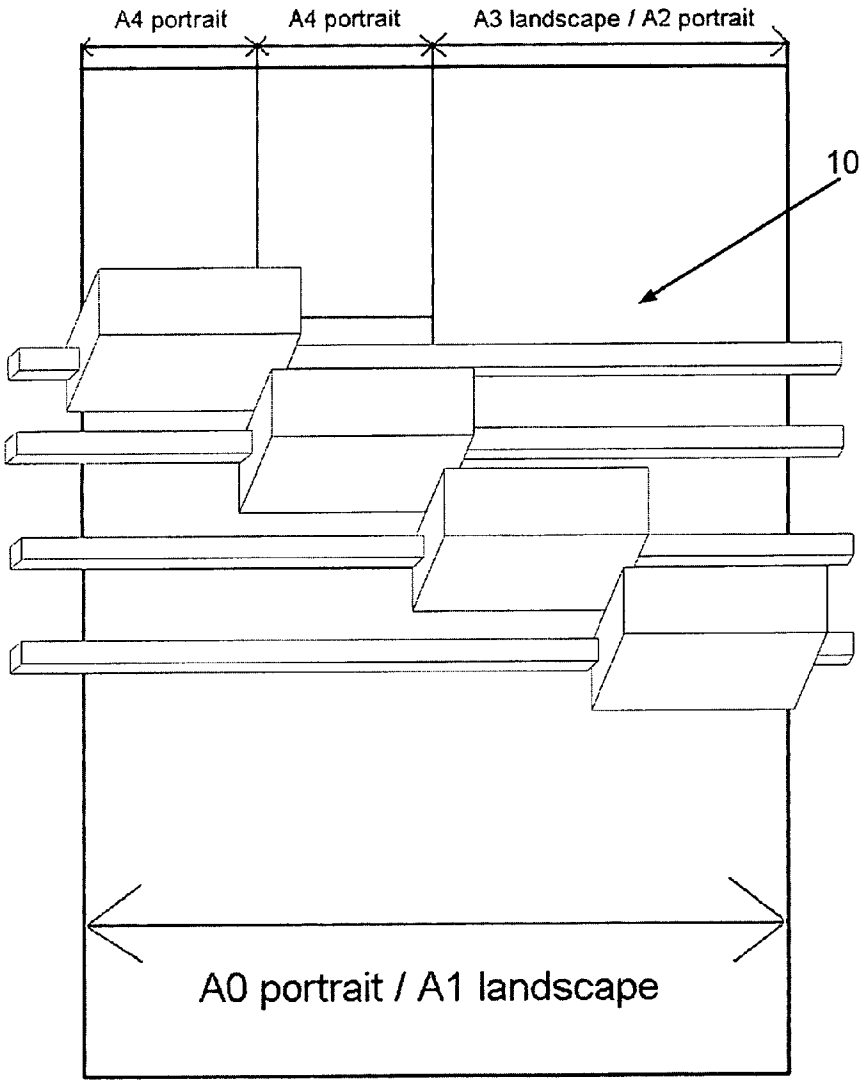
FIG. 5 is a perspective view showing a printhead assembly according to another embodiment of the invention.
Figure 6:
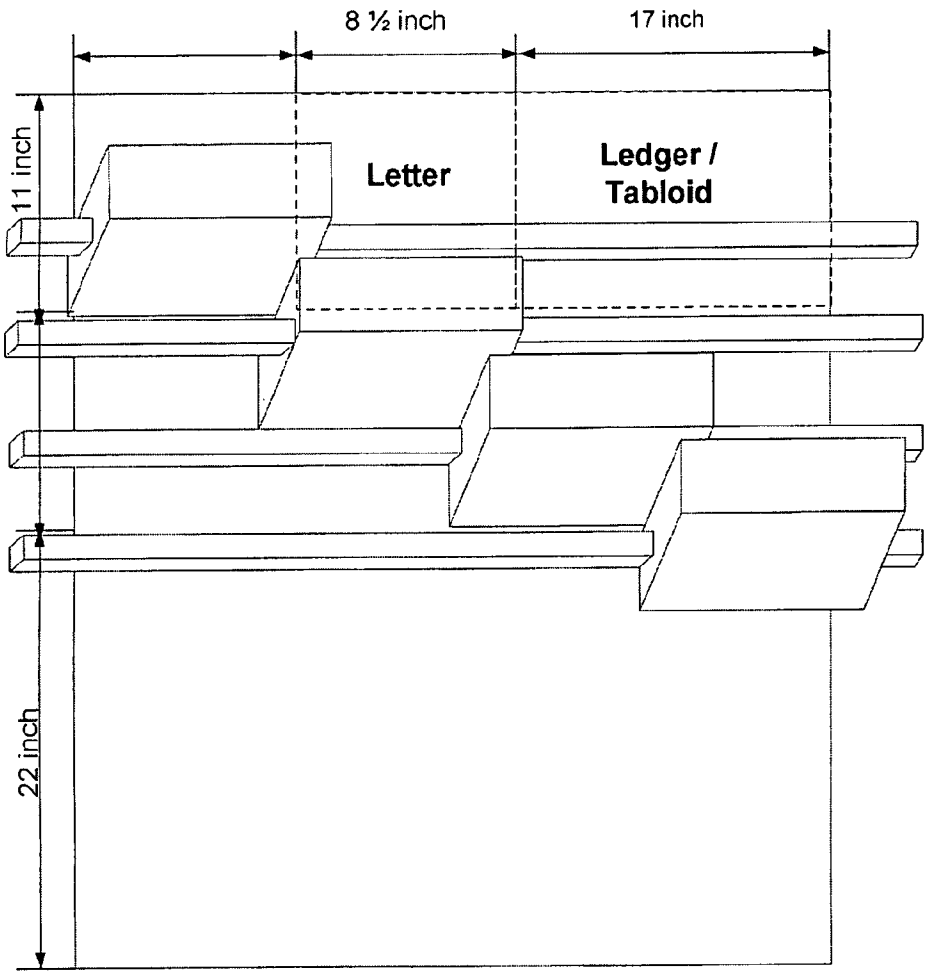
FIG. 6 is a perspective view showing a printhead assembly according to yet another embodiment of the invention.

FIGS. 5 and 6 show perspective views of other embodiments according to the invention. In these embodiments, printhead assembly 10 also comprises four printhead modules. The printhead modules substantially have a length encompassing the short side of A4 size paper or the short side of "letter" size paper. By choosing the length of the printhead in this way, improved printing of standard paper sizes is achieved.

A4 paper has a width of 210 mm and length of 297 mm. A3 paper has a width of 297 mm and a length of 420 mm. A2 paper has a width of 420 mm and a length of 594 mm. A1 paper has a width of 594 mm and a length of 841 mm. A0 paper has a width of 841 mm and a length of 1189 mm. These paper sizes are defined in the standard ISO 216. ISO standard 216 has been adopted by many countries around the world.

In the United States, a different standard (ANSI/ASME Y14.1) is in use. The standard paper sizes are "letter" (8½ inch×11 inch) and "ledger" (17 inch×11 inch)/ "tabloid" (11 inch×17 inch), ANSI C (17 inch×22 inch), ANSI D (22 inch×34 inch) and ANSI E (34 inch×44 inch). The two standards have in common that cutting a sheet in half would produce two sheets of the next smaller size. "Letter" size paper has almost the same dimensions as A4 paper, which is slightly smaller. "Ledger" paper closely corresponds to A3 paper, and so on.

Throughout the application, if it is mentioned that the length of a printhead corresponds to a certain length, this is to be interpreted such that the printing system(s) arranged along the printhead (i.e. nozzles in the case of an inkjet printer) extend over such a length. The actual printhead may have a slightly different size since it comprises e.g. a frame that carries the printing system(s).

The particular possibilities and advantages of the embodiments shown in FIGS. 5 and 6 will now be explained with reference to FIG. 5. From this, the skilled person will understand that similar possibilities and advantages exist in the embodiment of FIG. 6.

A first possibility with the embodiment is to position all printhead modules in such a way that they substantially completely overlap (similar to the positions shown in FIG. 3). In this arrangement, A4 paper (or letter size paper) or smaller can be printed at high speed and/or at high image quality, since redundancy of the printheads is maximum.

A second possibility with this embodiment is to arrange the printhead modules in two sets of two (similar to the positions shown in FIG. 4), such that the printheads extend over a length corresponding to the short side of A2 paper. This means that A3 paper (or "ledger" paper) can be printed "in landscape" and A2 paper can be printed "in portrait". Additionally, redundancy for each printhead is achieved.

A third possibility of positioning the modules in this embodiment is to arrange the four printhead modules substantially not overlapping in the media advance direction (similar to the positions shown in FIG. 2). In this position, the printhead modules extend over a length corresponding to the short side of A0 paper (or ANSI E paper).

A fourth possibility of positioning the printhead modules in this embodiment is to arrange three printhead modules next to each other (i.e. not overlapping in the media advance direction) and position the fourth printhead module to cover an area where increased quality of the image is desired, or to cover an area in which the density of the image to be printed is especially high. In this position, the printheads extend over a length corresponding to the short side of A1 paper, so this paper size can be printed. Additionally, in areas where this is desired (increased image density, increased image quality), redundancy of the printhead is provided.

It will be appreciated that other advantageous possibilities of positioning the printhead modules may also be employed.

In conclusion, in the embodiment of FIG. 5, paper sizes A0, A1, A2, A3 and A4 (and of course image sizes smaller than that) can be printed. The most suitable arrangement of the printhead modules can be chosen for each print job.

As should be clear now, with reference to the embodiment shown in FIG. 6, the printhead assembly can also be adapted to a different paper size standard. By giving a printhead module the length of the short side of the "letter" paper size (8½ inch), the same versatility is achieved, but for different paper sizes. Of course, if the printhead assembly is configured according to the US standard paper sizes, also the ISO 216 paper sizes can be covered, since they are slightly smaller.

Figure 7:
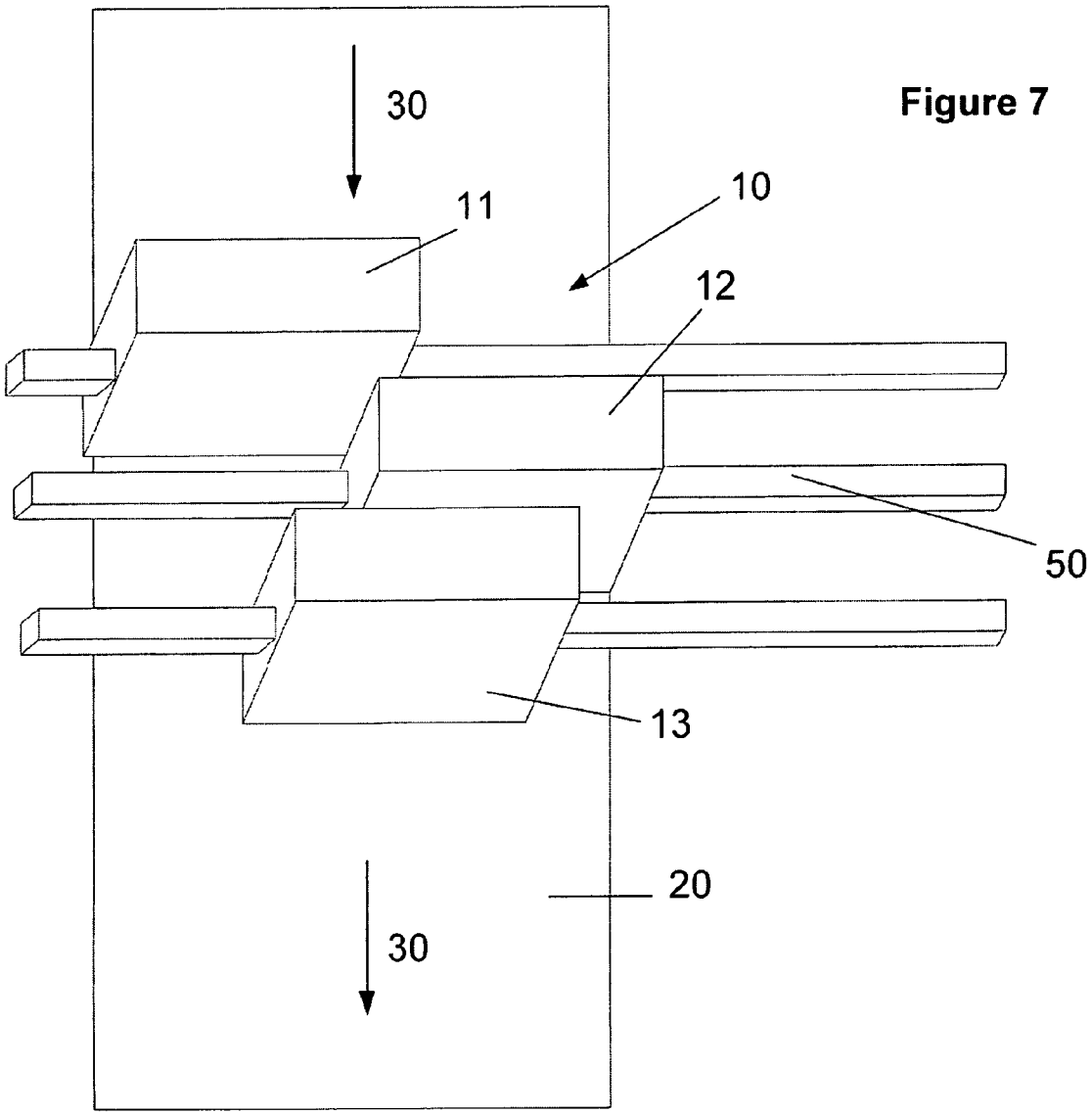
FIG. 7 is a perspective view showing a printhead assembly according to yet another embodiment of the invention.

FIG. 7 shows yet another embodiment of the present invention. The printhead assembly 10 according to this embodiment comprises three printhead modules 11, 12 and 13. At least printhead modules 12 and 13 are arranged to be movable in the width direction, perpendicular to media advance direction 30. If, in a method of printing, it is determined that the width of the image to be printed is larger than that that can be printed by printhead module 11, modules 12 and 13 can be moved to appropriate positions. If it is determined that the width of the image can be printed by two printhead modules, and additionally it is determined that there is a certain area of the image that may benefit from an additional printhead module (for reasons of image density, or image quality), the third printhead module can be positioned in such a way to cover this specific area.

One specific example of this can be as follows. If it is determined, that it would be beneficial to achieve an increase in image resolution, two of the printhead modules can be placed in such a way, that they are offset in the width direction by half the nozzle pitch. This way, the nozzle density along the length of the printhead can easily be doubled.

It will be appreciated that such offset by half the nozzle pitch can also be applied to overlapping modules in other embodiments, such as those shown in FIGS. 3 and 4. It will also be appreciated that modules can be offset in a width direction by a fraction of half the nozzle pitch, e.g. four modules can be offset in a width direction by a quarter of the nozzle pitch with a corresponding increase in image resolution.

Although only embodiments of the present invention containing two, three or four printhead modules have been shown, it is to be understood that the invention is not limited to these embodiments. Different embodiments of the present invention that were not described here may contain more printhead modules. Similarly, the relative position of the modules in the width direction may be different from those shown in the drawings. For example, in FIG. 2, module 11 could be set in the position in the width direction of module 12 and vice versa.

Even though the present invention was explained with explicit reference to an application as an inkjet printer, it should be understood that embodiments of the invention may also be employed in different image recording apparatus.

The invention claimed is:

1. A printhead for a printer in which a print medium advances in a media advance direction, said printhead being static when printing the medium and having an adjustable length in a width direction that is perpendicular to said media advance direction, comprising:

a mechanism that determines a width of an image to be printed and adjusts the length of the printhead in said width direction to the width of the image, such that the adjusted printhead is configured to print on any position of the print medium along the width of the image; and at least two printhead modules in the printhead that are statically disposed during a same printing pass to overlap in the width direction at a region of the medium which corresponds to a high-density area of the image.

2. A printhead for a printer as claimed in claim 1, wherein the length of the printhead in said width direction can be adapted to print on media of different sizes.

3. A printhead as claimed in claim 1, wherein the printhead comprises a plurality of printhead modules and the length of the printhead in said width direction is adaptable by appropriately positioning the modules.

4. A printhead as claimed in claim 3, wherein the arrangement of the printhead modules can be adapted for each print job, such that for each print job the appropriate positions for the modules can be chosen.

5. A printhead for a printer as claimed in claim 1, wherein the printhead includes at least one printhead module rotatable to form an angle with the width direction to adjust the length of the printhead in the width direction.

6. A printhead as claimed in claim 1, wherein nozzles of each of the at least two printhead modules are disposed at a nozzle pitch in the width direction, and wherein, during the same printing pass, one of the overlapping printhead modules is statically disposed in the width direction offset by a fraction of the nozzle pitch from another of the overlapping printhead modules.

7. A printhead as claimed in claim 6, wherein the overlapping printhead modules print, during the same printing pass, at a higher image resolution in the region than outside of the region.

8. A printhead assembly for printing on a medium which advances in a media advance direction, said printhead assembly being static when printing and comprising at least two printhead modules offset in the media advance direction, at least one of the printhead modules movable along a width direction perpendicular to the media advance direction to adjust the printhead assembly to print on any position of the print medium along the width of the image, wherein at least two of the printhead modules are statically disposed substantially completely overlapping in the width direction during a same printing pass.

9. A printhead assembly as claimed in claim 8, wherein the printhead assembly comprises four printhead modules.

10. A printhead assembly as claimed in claim 9, wherein each of said printhead modules substantially has the length of the short side of a standard paper size.

11. A printhead assembly as claimed in claim 8, wherein each of the printhead modules is adapted to be moved along said width direction.

12. A printhead assembly as claimed in claim 8, wherein it is an inkjet printhead assembly.

13. A printer comprising a printhead assembly as claimed in claim 8, which furthermore comprises a mechanism that determines the width of the image to be printed, where the image width is different from a width of the medium.

14. A printhead assembly as claimed in claim 8, wherein, during the same printing pass, a first printhead module is statically disposed in the width direction overlapping a second printhead module such that a properly-functioning nozzle of the first printhead module has the same position in the width direction as an improperly-functioning nozzle of the second printhead module.

15. A printhead assembly as claimed in claim 8, wherein nozzles of at least two of the overlapping printhead modules are disposed at a nozzle pitch in the width direction, and wherein, during the same printing pass, one of the overlapping printhead modules is statically disposed in the width direction offset by a fraction of the nozzle pitch from another of the overlapping printhead modules.

16. A printhead assembly as claimed in claim 15, wherein the overlapping printhead modules print, in a single printing pass, at a higher image resolution in the width direction relative to a non-overlapping printhead module.

17. A printhead for a printer in which a print medium advances in a media advance direction, said printhead being static when printing the medium and having an adjustable length in a width direction that is perpendicular to said media advance direction, comprising:

a mechanism that determines a width of an image to be printed and adjusts the length of the printhead in said width direction to the width of the image, such that the adjusted printhead is configured to print on any position of the print medium along the width of the image; and first and second printhead modules in the printhead statically positioned to overlap in the width direction such that a properly-functioning nozzle of the first printhead module has the same position in the width direction as an improperly-functioning nozzle of the second printhead module during a same printing pass.

* * * * *